US011220318B2

(12) United States Patent
Berton

(10) Patent No.: US 11,220,318 B2
(45) Date of Patent: Jan. 11, 2022

(54) BRACKET FOR MOUNTING A THRUSTER TO A BOAT

(71) Applicant: The Yacht Group, LLC, Coral Gables, FL (US)

(72) Inventor: Gerald Berton, Coral Gables, FL (US)

(73) Assignee: The Yacht Group LLC, Coral Gables, FL (US)

( * ) Notice: Subject to any disclaimer, the term of this patent is extended or adjusted under 35 U.S.C. 154(b) by 0 days.

(21) Appl. No.: 17/398,542

(22) Filed: Aug. 10, 2021

(65) Prior Publication Data

US 2021/0371075 A1 Dec. 2, 2021

Related U.S. Application Data

(63) Continuation-in-part of application No. 16/844,085, filed on Apr. 9, 2020.

(51) Int. Cl.
*B63H 21/30* (2006.01)
*B63H 1/16* (2006.01)

(52) U.S. Cl.
CPC ..... *B63H 21/30* (2013.01); *B63H 1/16* (2013.01)

(58) Field of Classification Search
CPC ..... B63H 20/00; B63H 20/02; B63H 20/06; B63H 21/30; B63H 21/36; B63H 1/00; B63H 1/02; B63H 1/16
USPC ..... 440/49, 53, 55, 66, 71, 76, 79, 82; 114/343
See application file for complete search history.

(56) References Cited

U.S. PATENT DOCUMENTS 3,024,759 A * 3/1962 Byrd ..... B63H 20/22 440/55
4,832,642 A * 5/1989 Thompson ..... B63B 39/061 114/285
5,016,553 A * 5/1991 Spencer ..... B63H 25/46 114/151
5,704,306 A * 1/1998 Den Ouden ..... B63H 5/14 114/151
6,102,757 A 8/2000 Ishigaki
6,267,633 B1 7/2001 Suganuma
6,581,537 B2 6/2003 McBride et al.
7,789,032 B1 9/2010 McDugle et al.
7,836,678 B1 11/2010 Yan et al.
8,893,503 B2 11/2014 Condaminet et al.
(Continued)

*Primary Examiner* — Daniel V Venne
(74) *Attorney, Agent, or Firm* — The Concept Law Group, PA; Scott D. Smiley; Scott M. Garrett

(57) ABSTRACT

A bracket for mounting a thruster to a boat includes a horizontal neck portion, an upper mounting support portion, a support plate portion that extends downward from the upper mounting support portion, and an enclosure portion. The support plate portion and the rear of the upper mounting support portion form a transom-facing surface in a plane that is at a non-right angle relative to a horizontal plane. The transom-facing surface is angled such that the bottom of the support plate portion is further to the rear of the thruster bracket than the top of the upper mounting support portion in order to match the angle of the transom of a boat to which the thruster bracket is mounted. A thruster is mounted to the thruster bracket at a level where the thruster will be out of the water when the boat is moving fast and up on plane, and will be in the water when the boat is moving very slow.

14 Claims, 15 Drawing Sheets

(56) References Cited

U.S. PATENT DOCUMENTS

| | | | |
|---|---|---|---|
| 10,953,974 | B2 | 3/2021 | Griffin et al. |
| 2021/0094665 | A1 | 4/2021 | Schmid et al. |

* cited by examiner

BRACKET FOR MOUNTING A THRUSTER TO A BOAT

CROSS-REFERENCE TO RELATED APPLICATION

This application claims priority to U.S. patent application Ser. No. 16/844,085, filed Apr. 9, 2020, the entirety of which is incorporated by reference.

FIELD OF THE DISCLOSURE

The present invention provides a bracket which is useful in mounting an aft thruster to a boat. The invention is especially intended for use with wakeboard boats, or wakesurfing boats, but is not necessarily limited to that field.

BACKGROUND OF THE DISCLOSURE

Wakeboarding, wakesurfing, wake sports are terms that refer to a sport or activity in which a person sits or stands on a wakeboard, and is towed by a boat, while maneuvering the wakeboard across the wake created by the boat, and while possibly performing various acrobatic stunts. The boat which tows the wakeboarder or creates the wake is called a wakeboard boat, and is designed to create a large and specially shaped wake that facilitates in performing jumps with various maneuvers.

It has been known to provide thrusters for boats to allow lateral movement of the front (bow) of the boat. A thruster is essentially a small marine thruster, typically electrically powered, having a propeller which engages the water in a transverse direction from that in which the main engine drives the boat, and which generates forces which can be used to turn or steer the boat. The thruster is normally auxiliary to the main engine of the boat and is used when the boat is moving slowly, or not moving (forward or rearward) at all, such as when docking, or in this case wake surfing.

Wakesports type boats are generally single-engine inboard boats, and they are very difficult to maneuver at very low speeds because they typically do not have thrusters, and they have only one rudder which is designed to provide turning at higher speeds. It has been recognized, therefore, that a thruster would be desirable for use with a wakesport boat.

However, it has been found that mounting a thruster to a wakeboard boat is more difficult than would be expected. Although a thruster may be small, including essentially a small electric motor and a propeller, wakesports boats typically have many components which limit the thruster water flow and space available for mounting any thruster. Such components may include trim tabs, wake adjusting apparatus, exhausts, and other items on the transom (i.e. the vertical surface at the stern of the boat), which in many cases is very small, eliminating the possibility of directly mounting a thruster. Further, the transom is typically formed at an angle relative to the bottom of the boat that is not a right angle, with the transom extending farther to the rear going up the transom. This allows for easier removal of the hull from a hull mold when the hull is fabricated.

Another problem with wakeboard boats is the need for light during night operations. Wakesport boats are generally not provided with lights on the stern of the boat, and the above-described space limitations apply equally with respect to installation of a light.

The present disclosure solves the above-described problems, by providing a special bracket which enables a thruster to be mounted to a wakesport boat in an advantageous operating position, and wherein the bracket also supports an underwater lamp which can work together with the thruster.

SUMMARY OF THE DISCLOSURE

In accordance with some embodiment of the inventive disclosure, there is provided a thruster bracket that includes an upper mounting support portion having a support plate portion that extends downward from a bottom of the upper mounting support portion and which defines a transom-facing surface together with a rear side of the upper mounting support portion. The thruster bracket also includes a horizontal neck portion that extends from the upper mounting support portion opposite the transom-facing surface. The thruster bracket also includes an enclosure portion extending from the horizontal neck portion opposite the upper mounting support portion. A bottom of the enclosure portion and the horizontal neck portion define a horizontal plane, and an angle between the horizontal plane at the bottom of the horizontal neck portion and the transom-facing surface is greater than ninety degrees.

In accordance with a further feature, the angle between the horizontal plane at the bottom of the horizontal neck portion and the transom-facing surface is between ninety three and one hundred and eight degrees.

In accordance with a further feature, the thruster bracket further includes a threaded conduit extending from the upper mounting support portion from an opening in the transom-facing surface, the threaded conduit having an axis that is at ninety degrees to the transom-facing surface.

In accordance with a further feature, the thruster bracket further includes a rubber pad having an opening that fits over the threaded conduit and wherein the rubber pad lays against the transom-facing surface.

In accordance with a further feature, the enclosure has a recessed rim at a tip of the enclosure portion and includes a cover that sits on the recessed rim.

In accordance with a further feature, the bottom of the enclosure portion includes openings for receiving threaded fasteners of a thruster to couple the thruster to the thruster bracket.

In accordance with some embodiment of the inventive disclosure, there is provided a bracket for mounting a thruster to a boat, the bracket includes a horizontal neck portion that extends from an upper mounting support portion, a support plate portion extending downward from the upper mounting support portion and forming a transom-facing surface with a rear of the upper mounting support portion. The horizontal neck portion and support plate portion are positioned generally at a greater than right angle to each other. The bracket further includes an enclosure portion extends from the horizontal neck portion opposite the upper mounting support portion, the enclosure portion having openings in a bottom of the enclosure portion to couple the bracket to a thruster, and the enclosure portion has a recessed cover.

In accordance with a further feature, the horizontal neck portion has a width, and wherein the upper mounting support portion has a width has a length, and wherein the width of the horizontal neck portion is smaller than the width of the upper mounting support portion.

In accordance with a further feature, the thruster bracket further includes a threaded conduit extending from the rear of the upper mounting support portion that in cylindrical and open into the horizontal neck portion and to the enclosure portion.

In accordance with a further feature, the thruster bracket further includes a pad having an opening disposed on the transom-facing surface with the threaded conduit passing through the opening.

In accordance with a further feature, the support plate portion has in inverted triangular shape, the bracket further comprises a plurality of bolts including one bolt that passes through the support plate portion and the pad at a lower tip of the support plate portion, and two bolts on either side of the horizontal neck portion that pass through the upper mounting support portion and the pad.

In accordance with a further feature, the enclosure portion is wider that either the upper mounting support portion of the horizontal neck portion.

In accordance with some embodiments of the inventive disclosure, there is provided a transom-mounted thruster system that includes a bracket having a horizontal neck portion that extends from an upper mounting support portion, a support plate portion extending downward from the upper mounting support portion and forming a transom-facing surface with a rear of the upper mounting support portion, the horizontal neck portion and support plate portion positioned generally greater than a right angle to each other, an enclosure portion that extends from the horizontal neck portion opposite the upper mounting support portion, the enclosure portion having openings in a bottom of the enclosure portion to couple the bracket to a thruster. The thruster system further includes a thruster mounted to an underside of the enclosure portion of the bracket and having a motor portion that is disposed under the horizontal neck portion, and a horizontally oriented guide tube having opposing open ends in which a propeller is located, the guide tube being oriented in a direction perpendicular to an elongated direction of the neck portion of the bracket.

In accordance with a further feature, the system includes a first thrust director coupled to a first one of the opposing open ends of the guide tube, and a second thrust director coupled to a second one of the opposing open ends of the guide tube, wherein each of the first and second thrust directors include an overhang at a top that directs water in a sideward and downward direction.

Although the invention is illustrated and described herein as embodied in a thruster bracket, it is, nevertheless, not intended to be limited to the details shown because various modifications and structural changes may be made therein without departing from the spirit of the invention and within the scope and range of equivalents of the claims. Additionally, well-known elements of exemplary embodiments of the disclosure will not be described in detail or will be omitted so as not to obscure the relevant details of the disclosure.

Other features that are considered as characteristic for the invention are set forth in the appended claims. As required, detailed embodiments of the present disclosure are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present disclosure in virtually any appropriately detailed structure. Further, the terms and phrases used herein are not intended to be limiting; but rather, to provide an understandable description of the disclosure. While the specification concludes with claims defining the features of the invention that are regarded as novel, it is believed that the disclosure will be better understood from a consideration of the following description in conjunction with the drawing figures, in which like reference numerals are carried forward. The figures of the drawings are not drawn to scale.

Before the present disclosure is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present disclosure, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present disclosure and simplify the description, but not to indicate or imply that the devices or components must have a specific azimuth, or be constructed or operated in the specific azimuth, which thus cannot be understood as a limitation to the embodiments of the present disclosure. Furthermore, terms such as "first", "second", "third" and so on are only used for descriptive purposes, and cannot be construed as indicating or implying relative importance.

In the description of the embodiments of the present disclosure, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the bracket in a horizontal direction when the bracket is properly installed on a boat and the boat is in its ordinary operational orientation. Those skilled in the art can understand the specific meanings of the above-mentioned terms in the embodiments of the present disclosure according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present disclosure.

DETAILED DESCRIPTION

Figure 1:
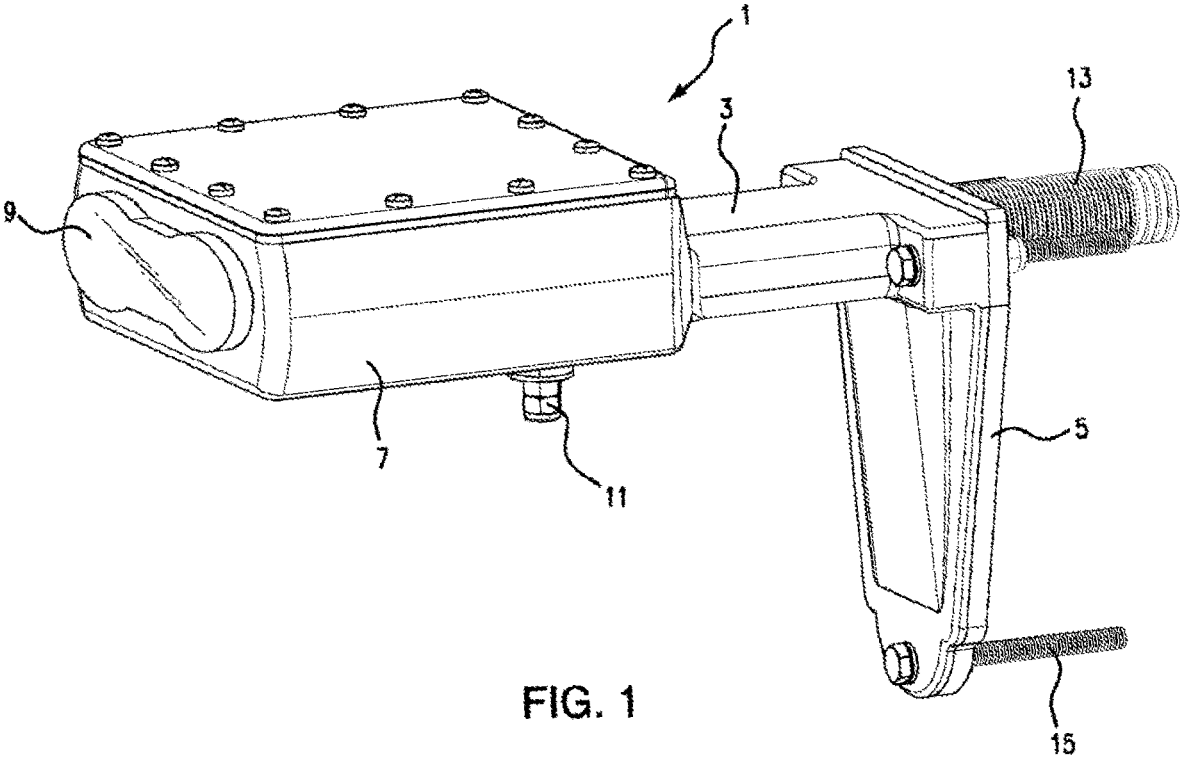
FIG. 1 shows a perspective view of a thruster bracket for mounting a thruster to the transom of a boat, in accordance with some embodiments.

While the specification concludes with claims defining the features of the disclosure that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present disclosure includes a thruster bracket for mounting a thruster to the transom of a boat, especially a wakesports boat. A transom mounting allows the thruster to be in the water when the boat is moving slowly, but to be out of the water when the boat is on plane, preventing the thruster from being a source of drag in the water.

The thruster bracket of the present disclosure is shown, in isolation, in FIG. 1. The thruster bracket 1 includes two pieces (3, 5) generally forming a right angle. The pieces 3 and 5 are designated the horizontal member and the vertical member, respectively, because, for normal attitudes of the boat, the members will assume these orientations. The horizontal member 3 has a length which is at least as great, and preferably greater, than the length of the vertical member 5. This feature causes the thruster to be held in spaced apart relation to the boat, as will be apparent later.

The horizontal member includes a free end, which is opposite the end that is connected to the vertical member. The free end of the horizontal member is the end at the left-hand side of FIG. 1.

The horizontal member 3 includes an enclosure 7, which is integral with, or firmly attached to, the horizontal member 3. For purposes of this description, the enclosure 7 is considered part of the horizontal member. Thus, in FIG. 1, the horizontal member 3, including the enclosure 7, is clearly longer than the vertical member 5.

The enclosure 7 comprises only a portion of the horizontal member 3, and is disposed towards the free end of such member, so that, when the thruster bracket is attached to the boat, the free end will be spaced away from the boat. The enclosure 7 contains a lamp, not shown in FIG. 1, but visible in FIG. 5 and indicated by reference numeral 31. When illuminated, the lamp shines its light through lens 9.

The lamp is preferably a high-power LED. However, the invention is not limited to a particular form of lamp, and other types of illuminating means could be used instead.

The horizontal member 3 is formed of a hollow tube which permits wires to be passed through the horizontal member to supply electrical power for the thruster and the lamp.

The horizontal member 3 includes one or more screws or fittings 11 for attachment of a thruster, as will be described in more detail later.

Extending from the vertical member 5 are bolts 15 for attachment of the bracket to a boat, and a threaded conduit 13. Threaded conduit 13 has a diameter larger than the diameter of the bolts 15, and is hollow, so that wires 24, which extend through the hollow horizontal member, can be connected to a power source, and to other components, in the boat, to power the lamp and the thruster. The threaded conduit 13 is threaded on the outside in order to receive a nut. Bolts 15 are conventional bolts. Other means of running the wires can be used instead of the arrangement described above.

The vertical member 5 can include a compliant (e.g. rubber) pad that sits between the exterior wall of the transom of the boat and the metal portion of the vertical member 5. The bracket 1 can thus be attached to the transom of the boat by forming holes in the transom, inserting the bolts 15 and the threaded conduit 13 through the holes, and screwing nuts onto the bolts and the threaded conduit 13, and tightening the nuts until the vertical member is firmly held against the transom. The complaint pad can help to exclude water from penetrating the holes created for the bolts 15 and the conduit 13.

Figure 2:
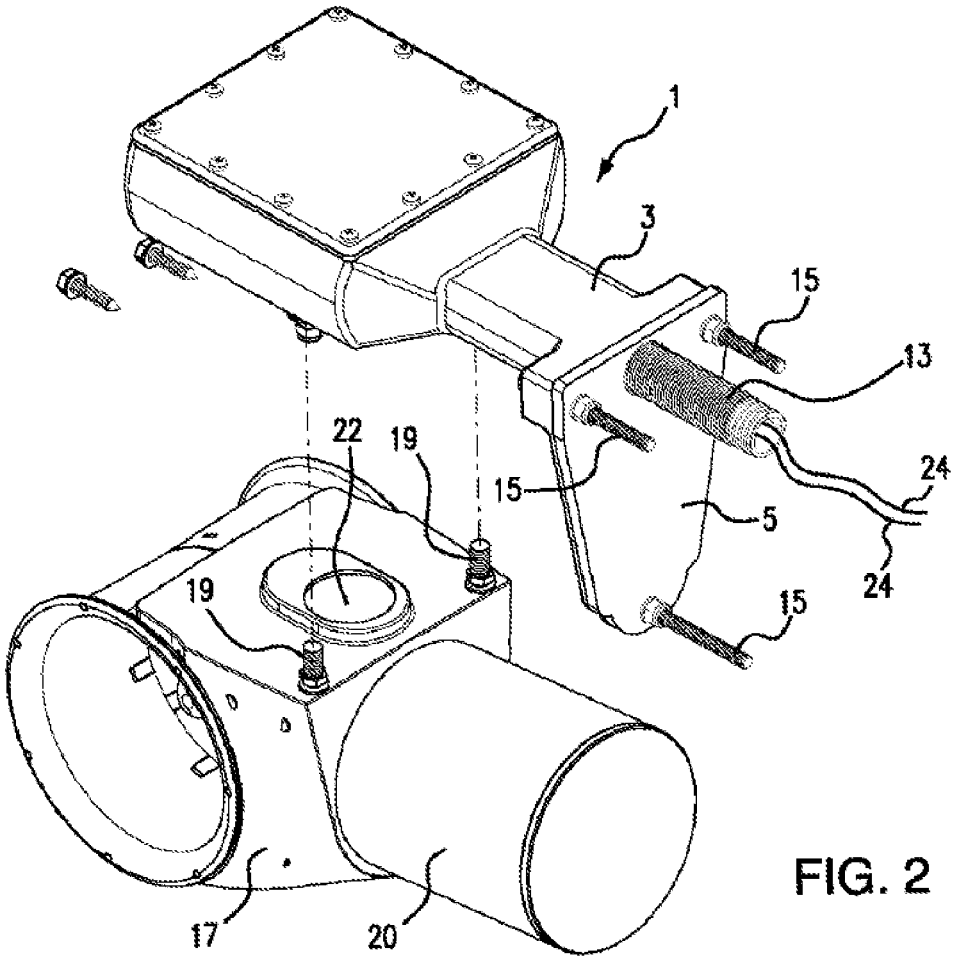
FIG. 2 shows an exploded perspective view of the thruster bracket of the present disclosure, and a thruster which is to be attached to the thruster bracket for mounting to the transom of a boat, in accordance with some embodiments.

FIG. 2 provides an exploded perspective view, showing the attachment of a thruster to the bracket 1 of the present invention. The thruster itself is not part of the present invention, but instead is a component which can be obtained commercially. For example, thrusters of the type shown in the present application may be obtained from Yacht Controller, LLC, of Coral Gables, Fla.

As shown in FIG. 2, thruster 17 includes cylindrical housing 20 which encloses a motor (not shown) which drives the propeller of the thruster. The thruster body includes threaded fasteners 19 which enable the thruster body to be mounted to horizontal member 3, and specifically the bottom of the enclosure 7, of bracket 1. Thus, when the boat is in its normal attitude, the thruster is effectively suspended from, and firmly attached to, the horizontal member 3 of the bracket, while being held in a position which is spaced apart from the boat. Opening 22 allows wires from the horizontal member 3 of the bracket 1 to be connected to the thruster motor, to power and control the motor.

The thruster 17 is shown here in a generally horizontal orientation, with the motor 20 and the propeller(s) in a generally horizontal relationship. The thruster 17 can be a unit intended for vertical mounting, such as a bow thruster unit that is mounted in the bow of a boat, with the thruster 17 turned so that the motor 20 is above the propeller(s) in a vertical relationship. Thus, the thruster bracket 1 allows use of the thruster 17, which may have been intended for vertical mounting, in a horizontal mounting arrangement on the back of a boat.

Figure 3:
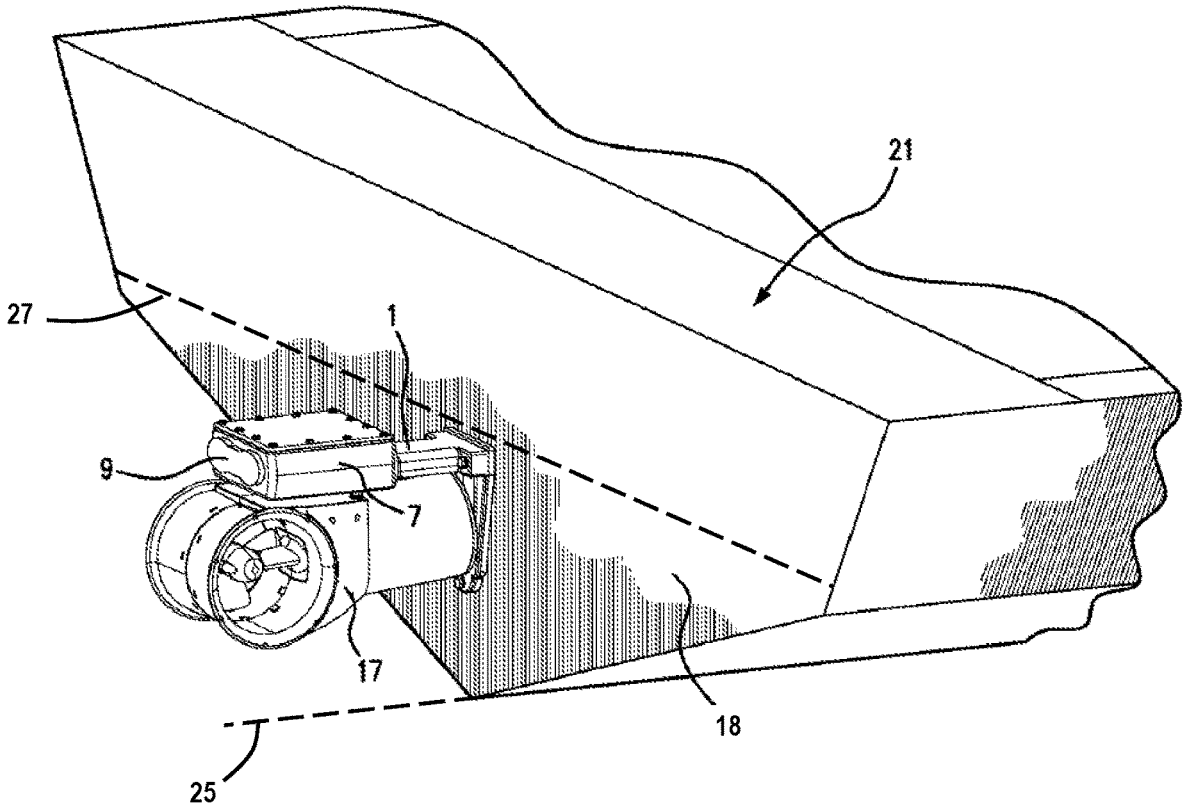
FIG. 3 shows a perspective view of the thruster bracket with the thruster mounted to the thruster bracket, and the thruster bracket being mounted to the transom of a boat (the boat being shown in fragmentary form), in accordance with some embodiments.

FIG. 3 shows the combination of the thruster bracket 1 of the present invention, with the thruster 17 attached to the bracket, and with the bracket attached to the transom 18 of the boat. The transom is the flat surface defining the stern of the boat.

FIG. 3 shows bracket 1, with thruster 17 attached to the underside of the horizontal member of the bracket, and with the vertical member of the bracket being attached to transom 18 of boat 21. The boat 21 is shown in fragmentary form, as the boat is not itself part of the invention, except as a member of a combination of elements. Thus, a description of the remaining portions of the boat is not considered necessary in a description of the present invention. FIG. 3 also shows the enclosure 7 of bracket 1, and the lens 9 for the lamp inside the enclosure.

For simplicity of illustration, the other components that may be present on the transom are not shown in FIG. 3. Indeed, FIG. 3 is not necessarily drawn to scale. In one embodiment, the thruster could be 5 inches wide, and the boat could be 96 inches wide, so the ratio of boat width to thruster width could be almost 20, greater than what is shown in FIG. 3. But the figure does show the general principle that the bracket of the present invention takes up relatively little space on the transom. The invention should not be considered limited to any particular set of dimensions.

The boat shown in fragmentary form in FIG. 3 is a generic boat, and not a wakesport boat. In practice, in a wakesport boat, the distance from the bottom of the boat to the top of the stern, i.e. the distance from the bottom to a swim platform which may be placed at the top of the transom, could be as little as about 8-9 inches. Considering that the transom may already be filled with other devices, the space available for mounting of a thruster is, in practice, far less than what is shown in FIG. 3. That is why the bracket of the present invention is especially useful with wakesport boats. The thruster bracket 1 is positioned on the transom such that the bottom of the thruster is above the bottom of the boat, which is projected rearward by bottom line 25 to show that the thruster 17 is above the bottom line 25 of the boat 21. This prevents the thruster 17 from being in the water when the boat 21 is moving at a towing speed as the boat will be on plane at that speed. At the same time, in order for the thruster to be operable, it must be mounted below the low speed water line 27, which is the approximate level of the water when the boat is moving very slowly. Note that the position or level of the low speed water line 27 will vary from boat to boat, and with loading of the boat, but it will be appreciated by the those skilled in the art that the thruster 17 must positioned on the transom 18 such that it is in the water when the boat is moving very slowly in order to provide the benefit of the thruster operation.

Figure 4:
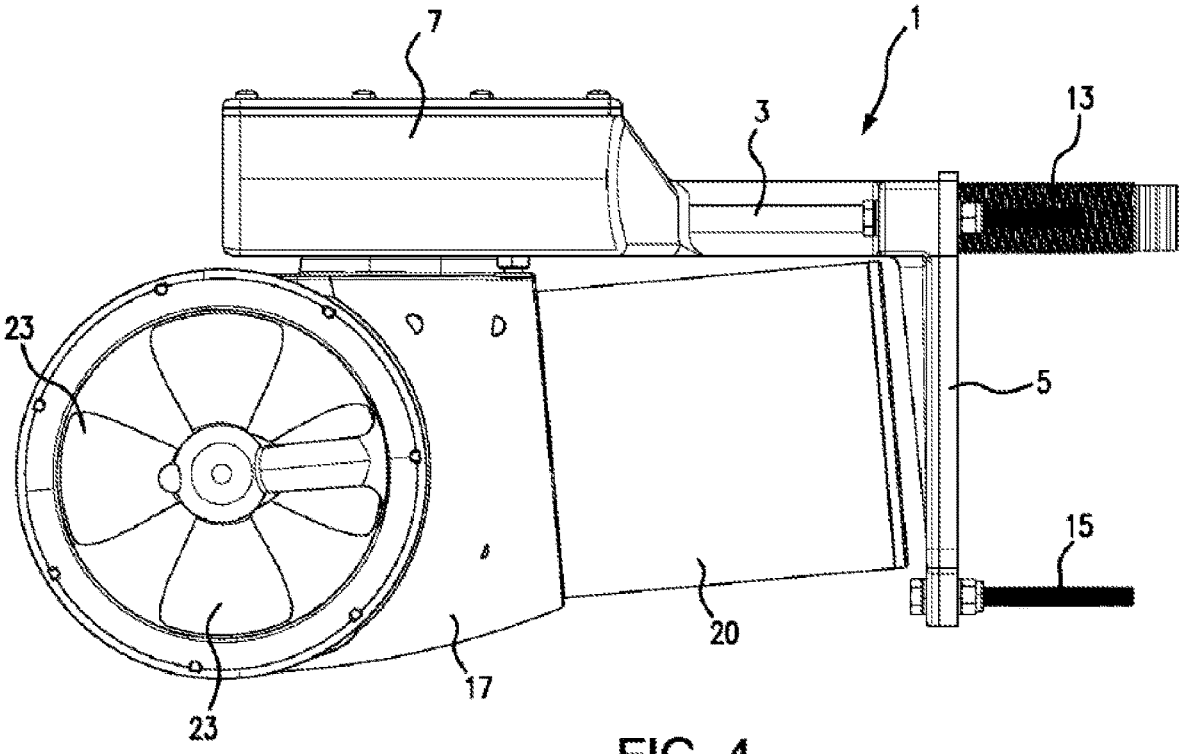
FIG. 4 shows a side elevational view of the thruster bracket holding a thruster and mounted to the transom of a boat, in accordance with some embodiments.
Figure 5:
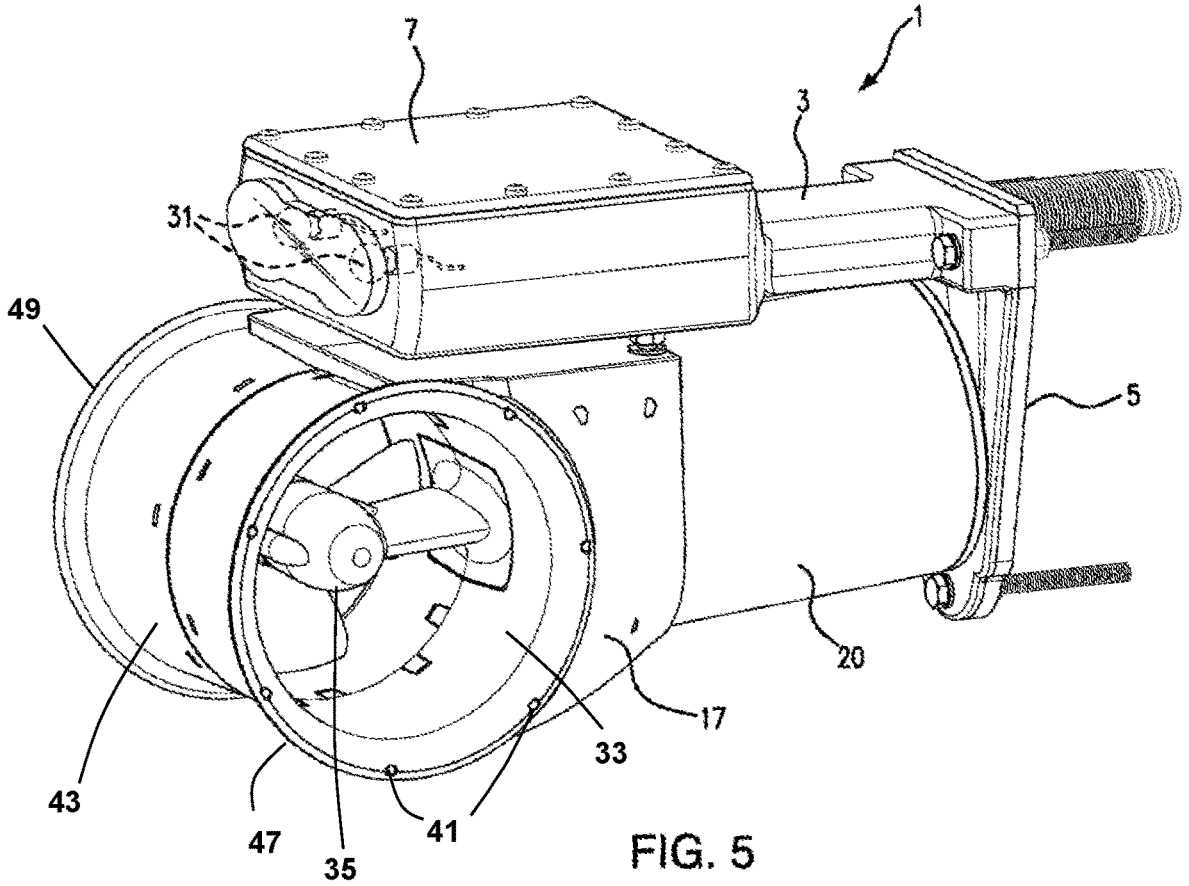
FIG. 5 provides a perspective view of the thruster bracket of the present disclosure, the thruster bracket holding a thruster, and showing the fasteners which are used to affix the bracket to a boat.

FIGS. 4 and 5 provide additional views of the combination of the bracket of the present invention, with an attached thruster. In FIG. 4, there is shown thruster 17, attached to the underside of horizontal member 3 of the bracket 1. In this view, one can see the propeller blades 23 of the thruster 17. In FIG. 4 it can be seen that the transom-facing side of the vertical member 5 is at a right angle to the axis of the horizontal member 3. Likewise, the screw conduit 13 and screw 15 (and other bolts that pass through the vertical member 5 and the transom) are horizontally oriented, at a right angle to the vertical member 5. This assumes the exterior surface of the transom will be vertical. If the exterior wall of the transom, to which the vertical member 5 is mounted, is not vertical, then the horizontal member 3 will be at an angle relative to true horizontal (e.g. perpendicular to the direction of gravity).

From FIGS. 3 and 4, it is clear that the bracket of the present invention enables the thruster to be positioned away from the transom of the boat. In FIG. 4, especially, one can see that the propeller blades are considerably displaced from the boat, which would be at the right-hand side of the figure.

FIG. 5 provides a view of the same components, from a different viewpoint. Also, FIG. 5 shows lamps 31, in dotted outline, the lamps being located within enclosure 7. Similar lamps are present in the enclosure as shown in the other figures. Further, in FIG. 5 the thruster 17 can be seen having a horizontally oriented guide tube 43 in which is thruster propeller 35 is disposed. The guide tube 43 includes openings on each side such as opening 33, and is oriented perpendicular to the direction of the horizontal portion 3 so that water moved by the propeller 35 through the guide tube 43 is moved in a sideways direction relative to the boat when the thruster 17 and bracket 1 are mounted on the transom of the boat. The guide tube 43 has circular ends 47, 49 on opposite sides of the guide tube 43, with each end forming a collar having a plurality of fastener holes 41 to receive bolts or equivalent fasteners. The propeller 35 is driven by the motor 20, and can spin in either direction (e.g. clockwise or counter-clockwise) to direct thrust in either direction.

An important advantage of the present disclosure is that it enables the mounting of the thruster such that the thruster is spaced apart from the boat. This feature is advantageous because it minimizes the space required on the transom, for mounting the thruster, and also because, by holding the thruster away from the boat, the flow of water is optimized, and the power available from the thruster is maximized. Therefore, when mounted with the bracket of the present invention, the thruster operates with maximum efficiency in maneuvering the boat.

The bracket of the present invention therefore solves the problem of dealing with the limited space available on the transom. The present invention makes it possible to mount a thruster to a boat, while taking up only a relatively small area on the transom, such area being essentially the area defined by the vertical member of the bracket.

The present invention therefore comprises a means for mounting a thruster in such a way that the thruster is held in an optimum operating position, and while providing an underwater light that can work in conjunction with the thruster.

The enclosure 7, which contains the lamp, is made water-tight to insure the integrity and longevity of the electrical connections.

The assembly comprising the bracket and the thruster can be easily installed on a boat. The installer simply places a template on the transom, drills pilot holes to receive the screws, and mounts the assembly to the boat. The assembly may be positioned beneath a swim platform (not shown) which extends, in the aft direction, from the transom of the boat.

The lamp contained within enclosure 7 can be connected to a joystick (not shown) controlled by the operator of the boat, so that the area in the vicinity of the boat becomes illuminated according to the position of the joystick.

Due to the structure of the bracket of the present invention, the lamp within enclosure 7 is effectively spaced apart from the boat hull, usually at least 12 inches away. Thus, the lamp can function as an extended rear headlight, working in conjunction with the thruster.

Figure 6:
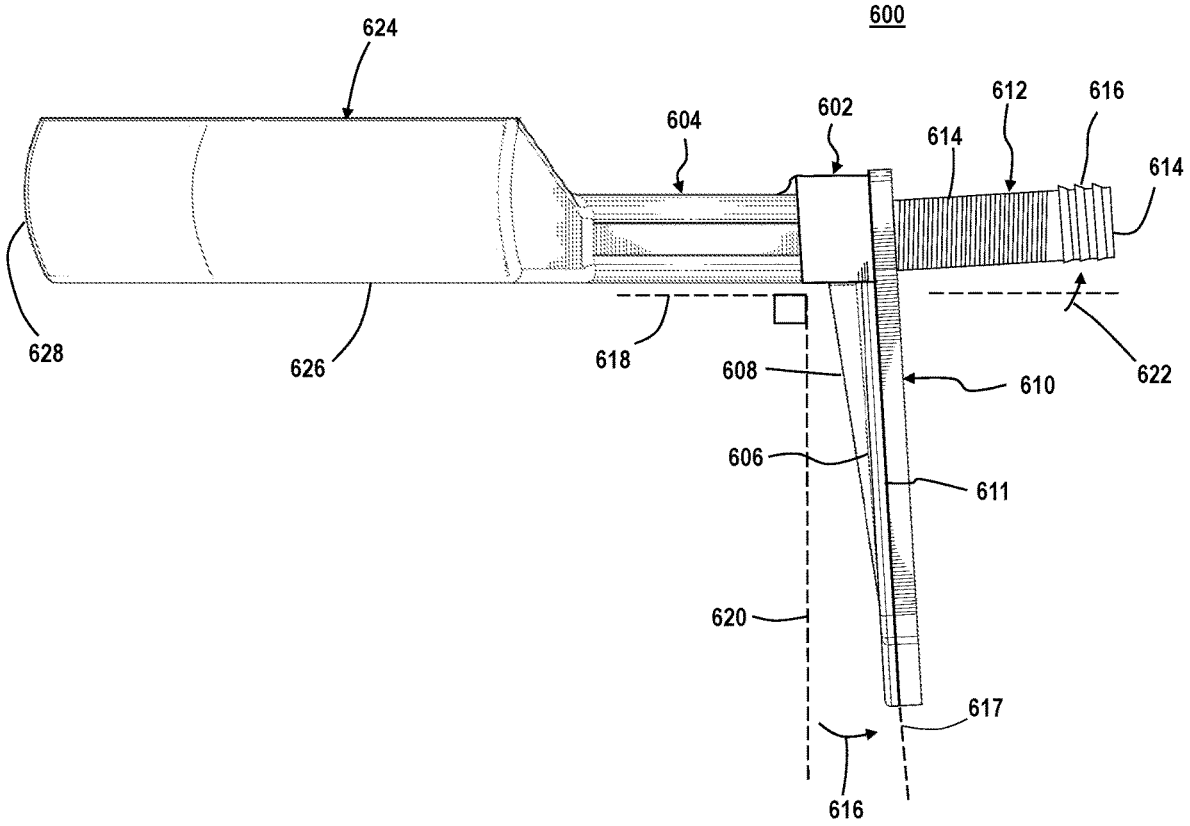
FIG. 6 shows a side elevational view of a thruster bracket having an angled mounting plate for mounting on the transom of boats where the transom is at a corresponding angle, in accordance with some embodiments.

FIG. 6 shows a side elevational view of a thruster bracket 600 having an angled mounting plate for mounting on the transom of boats where the transom is at a corresponding angle, in accordance with some embodiments. It has been found that a substantial number of boats are designed to have the transom angled from perpendicular, such that the top of the transom extends farther to the rear than the bottom of the transom. A thruster bracket such as that shown in FIG. 4, where the angle of the transom-facing surface of the vertical section 5 is at substantially a right angle to the horizontal section, would therefore angle the thruster downward if the bracket were mounted directly to the transom. An angled spacer pad could be used to account for the angle of the transom, but then the mounting bolts 15 and the threaded conduit 13 would be at an angle to the transom, resulting in stress differentials around the nuts used to secure the bracket to the transom.

To address this issue, the thruster bracket 600 accounts for this angle and allows the mounting hardware to pass through the transom at right angles to the transom wall, eliminating the issue of stress differential. In particular, the thruster bracket 600 includes an upper mounting support portion 602 from which a horizontal neck portion 604 extends. The upper mounting support portion 602 is the top or upper portion of the part of the thruster bracket 600 that mates to the transom. The horizontal neck portion 604 extends away from the upper mounting support portion 602 in a direction away from the transom mating or interface side. A mounting plate such as support plate portion 606 extends downward from the upper mounting support portion 602, and can include a support ridge 608 that narrows as it extends downward. An enclosure portion 624 extends from the horizontal neck portion 604 to a distal end 628, and has a substantially flat thruster mounting surface 626 at the bottom of the enclosure portion 624 that defines a horizontal plane, indicated by line 618. A vertical plane, indicated by line 620 is at a right angle to the horizontal plane 618. As can be see, the transom-facing surface 611 or side of the thruster bracket 600 at the upper mounting support portion 602 and the support plate portion 606 define a plane, indicated by line 617, that is an at angle, as indicated by line 616, relative to the vertical plane of line 620. This angle can be on order of three to fifteen degrees in some embodiments, or more or less in some embodiments, but is offset from vertical by some non-trivial angle. As a result, the angle of the plane along line 617 of the transom-facing surface 611 forms an angle with the horizontal plane along the bottom of the horizontal neck portion 604 and the bottom of the enclosure portion 624 parallel to line 618 that is greater than ninety degrees, and in some embodiments is in the range of ninety three to one hundred eight degrees to match the angle of the transom of a boat. Likewise, the threaded conduit 612 is mounted to have an axis that is perpendicular to the transom-facing surface along the plane of line 617, and is therefore at an angle to horizontal, as indicated by line 622 and at ninety degrees to the transom-facing surface. Further, the mounting bolts (not shown here) that pass through the upper mounting support portion 602 and the support plate portion 606 are parallel to the axis of the threaded conduit 612.

To provide some water intrusion resistance, as well as some vibration damping, a complaint pad 610 can be placed on the transom-facing surface of the thruster bracket 600. The compliant pad 610 can be, for example, a rubber material having a thickness of one eighth to one half of an inch, and has the same shape as the transom-facing surface of the thruster bracket 600. The material of the compliant pad 610 is such that it will not split upon being compressed between the exterior surface of the transom and the transom-facing surface of the thruster bracket, but less rigid than the material of both the transom and the thruster bracket. Further, the complaint pad 610 can have holes to allow the threaded conduit 612 and mounting bolts to pass through it.

The threaded conduit 612 is rigidly or fixedly mounted in the upper mounting portion 602, at an angle relative to the defined horizontal plane (e.g. line 618) and perpendicular to the transom-facing surface of the thruster bracket 600. The threaded conduit 612 is cylindrical, having an external surface that is partially threaded at threaded portion 614. Further, closer to the distal end 614 of the threaded conduit 612, there can be one or more anti-backoff ridges 616, These ridges surround the threaded conduit, and present a barb-like structure that is ramped, and functions to resist removal of, for example, a complaint washer or end cap fitted over the distal end. The threaded conduit is also hollow to allow wiring to pass through the threaded conduit 612 into the main body of the thruster bracket, and specifically into the enclosure 624.

Figure 7:
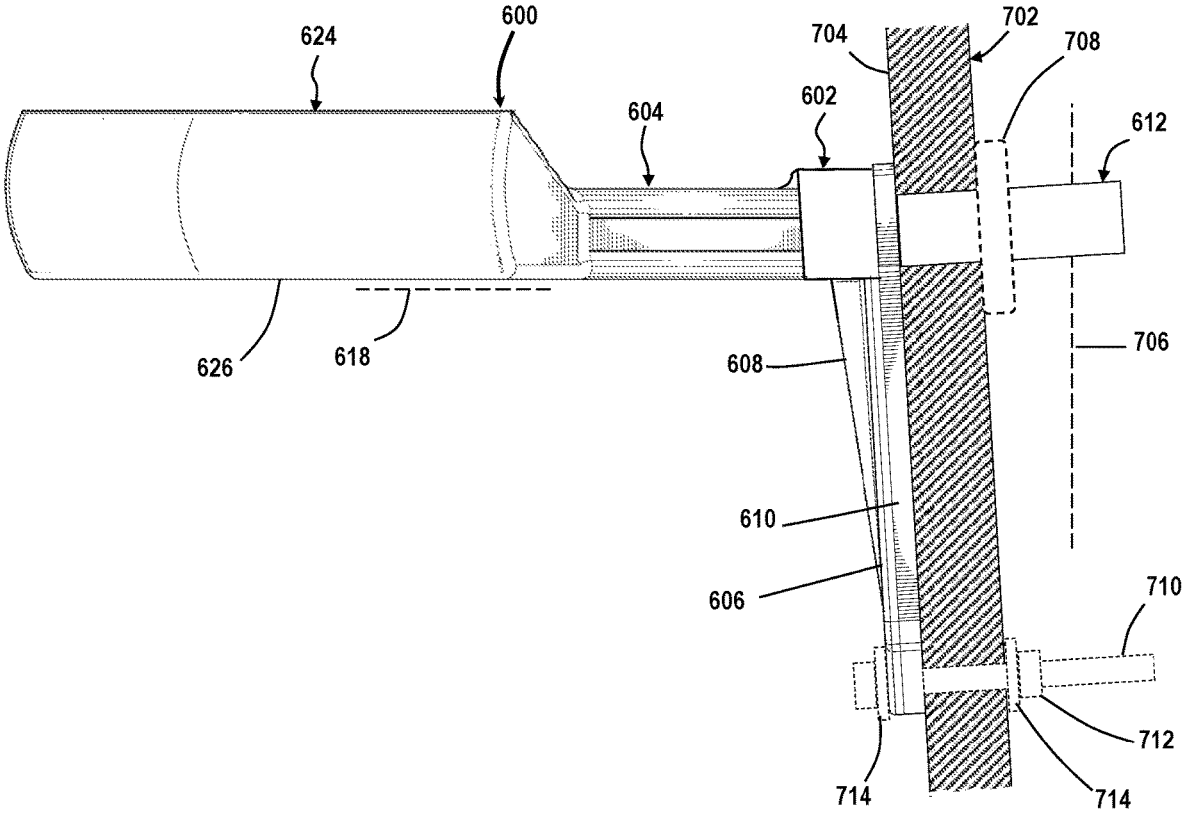
FIG. 7 shows a side elevational view of a thruster bracket having an angled mounting plate mounted on the transom (shown in cut-away) of a boat where the transom is at a corresponding angle, in accordance with some embodiments.

FIG. 7 shows a side elevational view of a thruster bracket having an angled mounting plate mounted on the transom 702 (shown in cut-away) of a boat where the transom is at a corresponding angle, in accordance with some embodiments. The transom 702 is equivalent to transom 18 of FIG. 3, and is the wall at the stern of the boat. The transom 702 has an external surface 704 against which the thruster bracket 600 is mounted. The transom 702 is angled relative to vertical, as represented by line 706, such that the upper portion of the transom 702 is further to the rear of the boat. There are holes or opening formed through the transom 702 to allow the threaded conduit 612 and mounting bolts 710 to pass through the transom 702. A retaining nut 708 can be threaded over the threaded conduit 612 to hold pull the thruster bracket 600 against the transom. Likewise, the mounting bolts 710 can have washers 714 and nut 712 to further secure the thruster bracket 600 to the transom 702. As a result, while the transom 702 is at an angle to vertical (e.g. line 706), the bottom mounting surface 626 is horizontal (e.g. line 618). Even if the angle of the transom 702 relative to vertical is not the same as the angle of the transom-facing surface of the thruster bracket, the enclosure portion 624 and the bottom surface 626 will be lifted relative to a thruster bracket as shown in FIG. 4. The thruster (e.g. 17) is mounted to the thruster bracket 600 substantially as shown in FIGS. 2-5.

Figure 8:
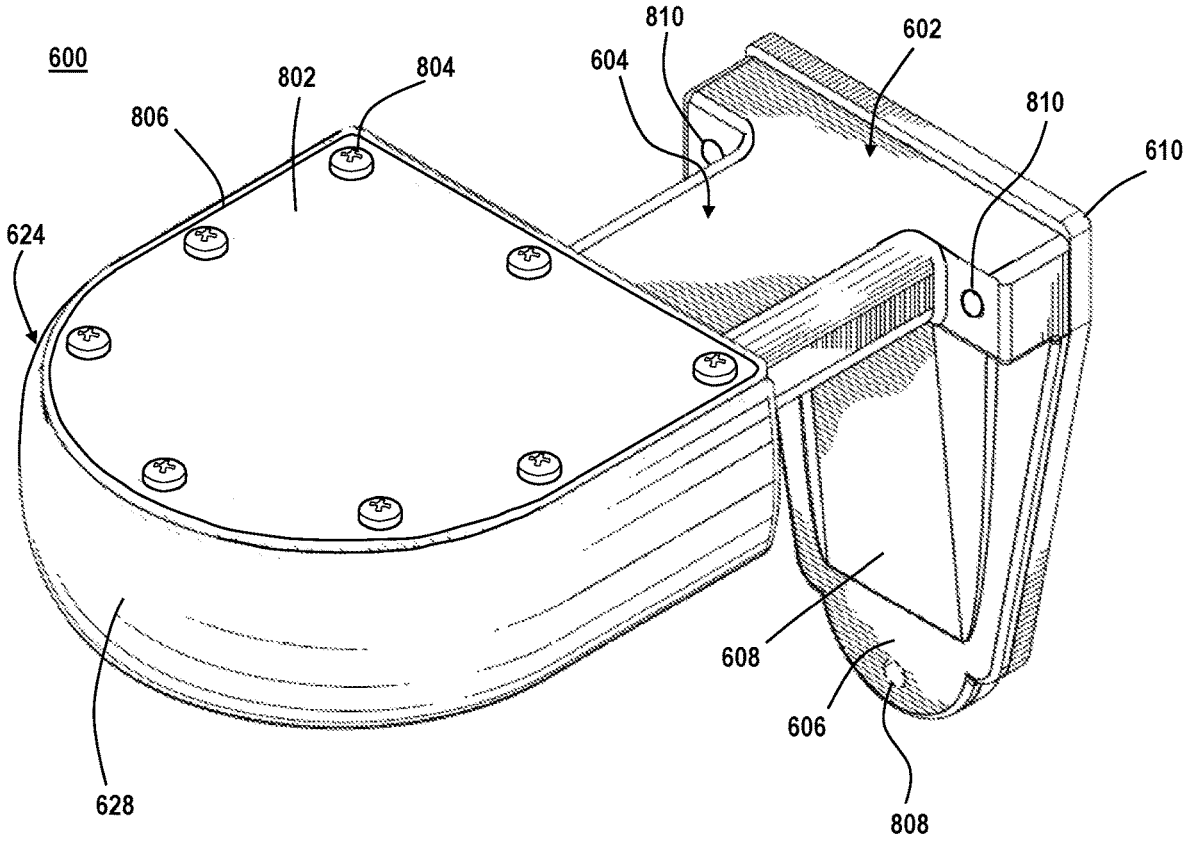
FIG. 8 shows a top perspective view of a thruster bracket having a recessed cover, in accordance with some embodiments.
Figure 9:
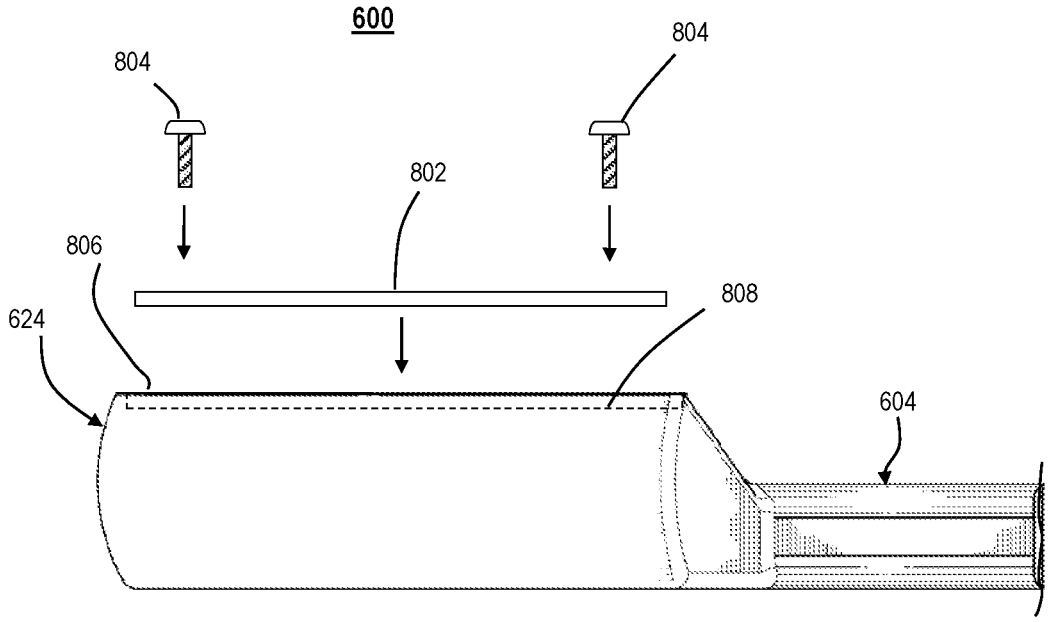
FIG. 9 shows a partial exploded side view of a portion of a thruster bracket having a recessed cover, in accordance with some embodiments.
Figure 10:
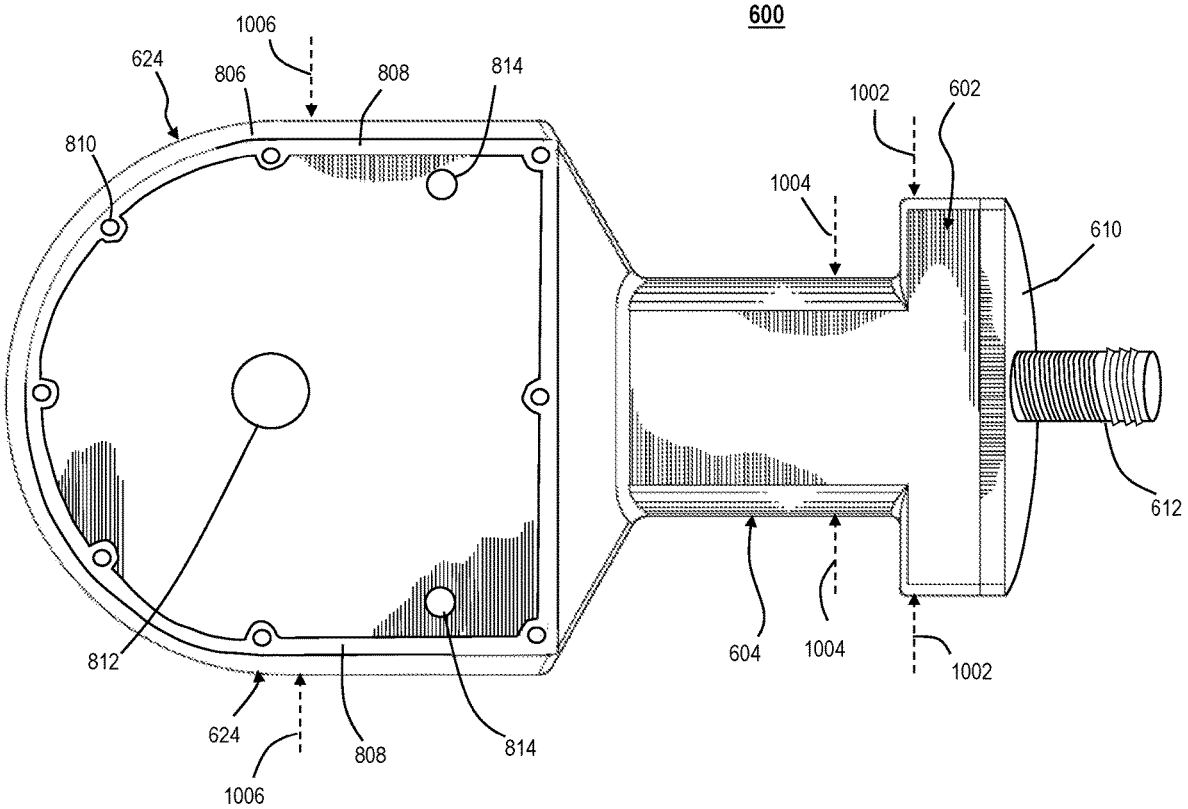
FIG. 10 shows an overhead view of a thruster bracket having a recessed cover, with the cover removed, in accordance with some embodiments.

FIG. 8 shows a top perspective view of a thruster bracket 600 having a recessed cover 802, in accordance with some embodiments. FIG. 9 shows a partial exploded side view of a portion of the thruster bracket 600 with the cover 802 over, but not assembled to the enclosure portion 624, and FIG. 10 shows a top view of the thruster bracket 600 with the cover 802 removed. The cover 802 can be secured to the enclosure portion 624 by a plurality of machine screws 804, and fits within a recessed inner rim 808 at the top 806 of the enclosure portion 624. The screws 804 pass through openings in the cover 802 and into threaded bosses 810 in the internal cavity of the enclosure portion 624. When the cover 802 is fit into the top 806 of the enclosure portion 624 the bottom of the cover 802, around the periphery of the cover 802 rests on the inner rim 808, which is recessed and below the top 806, forming a ledge around the top opening of the enclosure portion 624. A central opening 812 in the bottom of the enclosure portion 624 allows wires to pass to the thruster (e.g. through opening 22 of the thruster 17), and bolt openings 814 in the bottom of the enclosure portion 624 can receive the threaded fasteners 19 of the thruster 17 to mount the thruster 17 to the thruster bracket 600, with wiring passing through the enclosure portion 624, the horizontal neck portion 604, upper support portion 602 and threaded conduit 612 to controls in the boat that allow the boat operator to activate and control the speed and direction of thrust of the thruster 17.

Further, it can be seen that the support plate portion 606 has an inverted triangular shape, coming to a centrally located bottom under the threaded conduit, and having a bottom bolt opening 808. A pair of upper bolt openings 810 are positioned on either side of the horizontal neck portion 604 through the upper mounting support portion 602. Thus, as indicated in FIG. 10, the upper mounting support portion 602 has a width between lines 1002 that is wider that the width of the horizontal neck portion 604, which is indicted between lines 1004. And the enclosure portion 624 is wider still as indicated between lines 1006. In some embodiments the width of the upper mounting support portion 602 can be on the order of 5.0"+/−0.5", the width of the horizontal neck portion 604 can be on the order of 3.0"+/−0.5", and the width of the enclosure portion 624 can be on the order of about 7.0"+/−0.5". The height of the transom-facing surface 611, from bottom to top of the upper mounting support portion 602 can be on the order of 7"-8"+/−0.5". In some embodiments these dimensions may be larger or smaller than those mentioned here as exemplary. As used here, the "width" of various portions of the bracket is in a direction parallel to the horizontal plane, and perpendicular to the direction in which the threaded conduit extends from the upper mounting support portion 602. Furthermore, it should be understood that the upper mounting support portion 602, the horizontal neck portion 602, and the enclosure portion 624 are generally hollow, and the thruster bracket can be made of a metal material such as aluminum or stainless steel, with the exterior of the thruster bracket, including the recessed cover of the enclosure portion 624, being covered in corrosion resistant surface treatment, such as anodizing or powder coating.

Figure 11A:
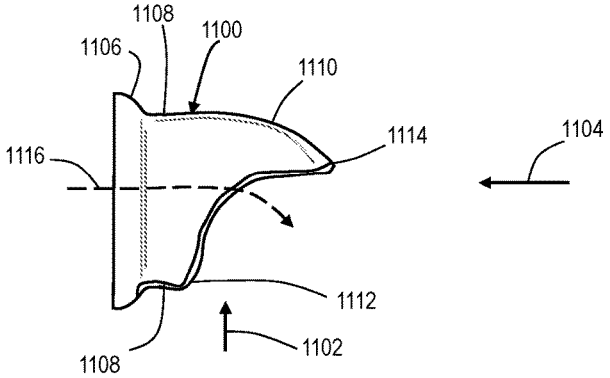
FIGS. 11A-11C show various views of a thrust director that can be connected to a thruster guide tube to direct water moved by the thruster, in accordance with some embodiments.
Figure 11B:
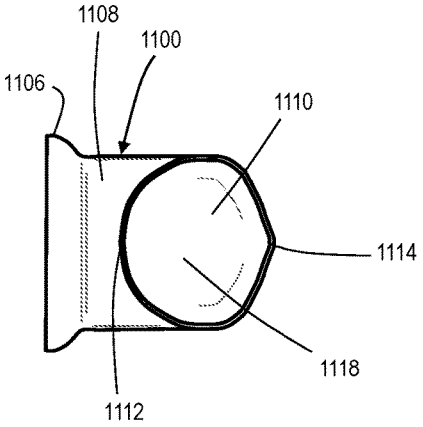
Figure 11C:
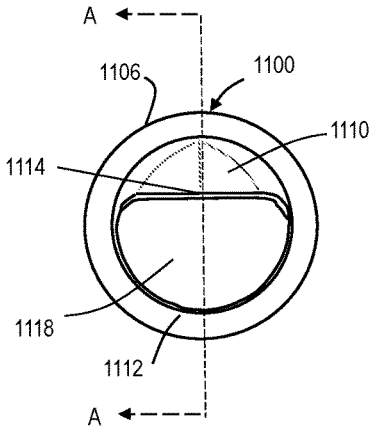
Figure 11D:
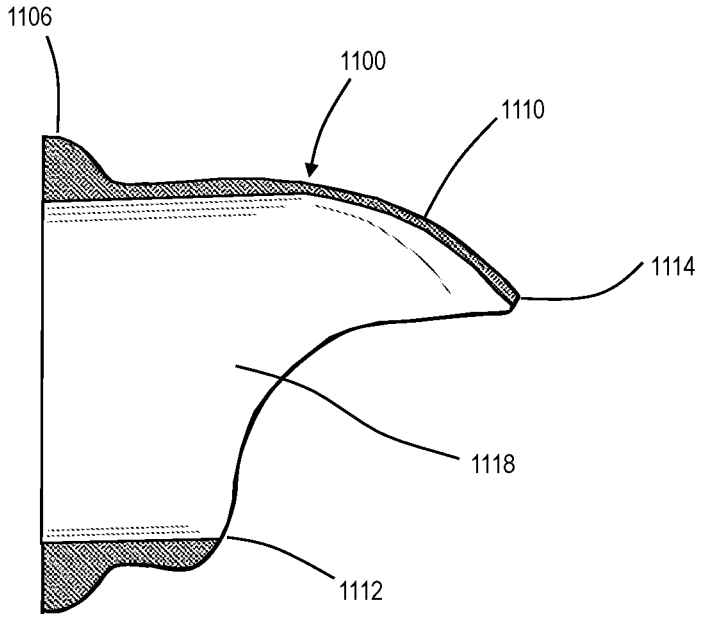
FIG. 11D shows a side cut-away view of the thrust director of FIGS. 11A-11C.

FIGS. 11A-11D show various views of a thrust director 1100 that can be connected to a thruster guide tube (e.g. 43) to direct water moved by the thruster (e.g. 17), in accordance with some embodiments. Referring also, briefly, to FIG. 5, the thrust director 1100 can be mounted on an end 47, 49 of the thruster guide tube 43 to further direct water moved through the guide tube 43 by the propeller 35. FIG. 11A shows a side elevational view of the thrust director 1100, FIG. 11B shows a bottom view of the thrust director 1100 looking in the direction of arrow 1102, FIG. 11C shows a front elevational view of the thrust director 1100 looking in the direction of arrow 1104, and FIG. 11D shows a cut-away view of the thrust director 1100 taken through the vertical center plane indicated by line A-A in FIG. 11C.

The thrust director 1100 has a collar 1106 that is sized to mate with the ends 47,49 of the guide tube 43, and can include fastener opening to receive fasteners that also pass through holes 41 to mount the thrust director 1100 on the end 47, 49 of the guide tube 43. Note that the collar 1106, like the ends 47, 49 of the guide tube 43, flare outward so as to avoid having structure inside the guide tube 43 and flow passage that would create drag or turbulence. A tube body 1108 extends from the collar and has in internal diameter/shape that is the same as that of the guide tube 43. When the propeller 35 is spun, water moves through the guide tube 43 and through the thrust director 1100 in the direction of arrow 1116 (or in the opposite direction, depending on the direction of spin of the propeller 35). The tube body 1108 of the thrust director 1100 extends a first distance from the collar 1106 at the bottom 1112, and a further distance at the top such that an overhang 1110 is formed. The overhang 1110 turns downward such that a distal end 1114 is in the line of the passage 1118 through the guide tube 43 and the tube body 1108. Thus, the overhang 1110 diverts water in a downward direction in addition to the horizontal direction. The distal end 1114 of the overhang 1110 can extend downward between one third and one half the diameter of the passage 1118 in some embodiments. The opening can extend from the bottom 1112 in a generally vertical direction up to about the level of the distal end 1114 and then extend forward around the distal end 1114 to give sufficient clearance for the water being directed though the thrust director 1100.

Figure 12:
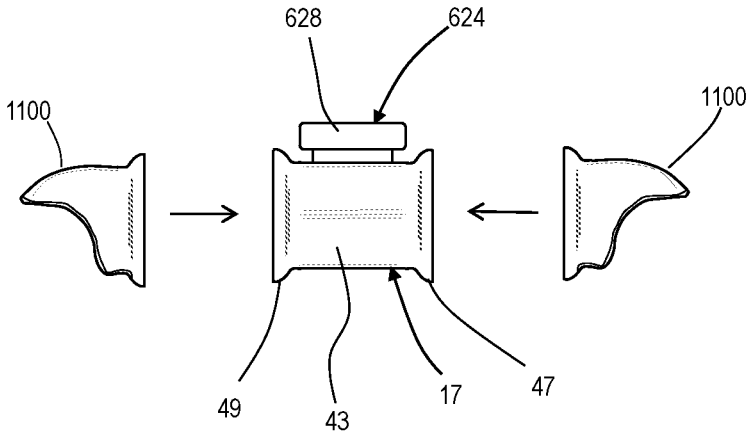
FIG. 12 shows an exploded assembly view from the rear of a thruster mounted on a thruster bracket, where a pair of thrust directors are mounted on the thruster guide tube, in accordance with some embodiments.

FIG. 12 shows an exploded assembly view from the rear of a thruster 17 mounted on a thruster bracket, where a pair of thruster directors 1100 are shown not yet mounted on the thruster guide tube 43, in accordance with some embodiments. The thruster 17 is substantially the same as that shown in FIG. 5, and is attached to the enclosure portion 624 (e.g. via bolts through openings 814) of the thruster bracket 600. Each of the thrust directors 1100 are attached at opposite ends 47, 49 of the guide tube 43, facing away from each other. The thrust directors 1100 are each moved as indicated by the arrows into contact with the ends 47, 49 of the guide tube 43, and then fastened to the guide tube 43.

Figure 13:
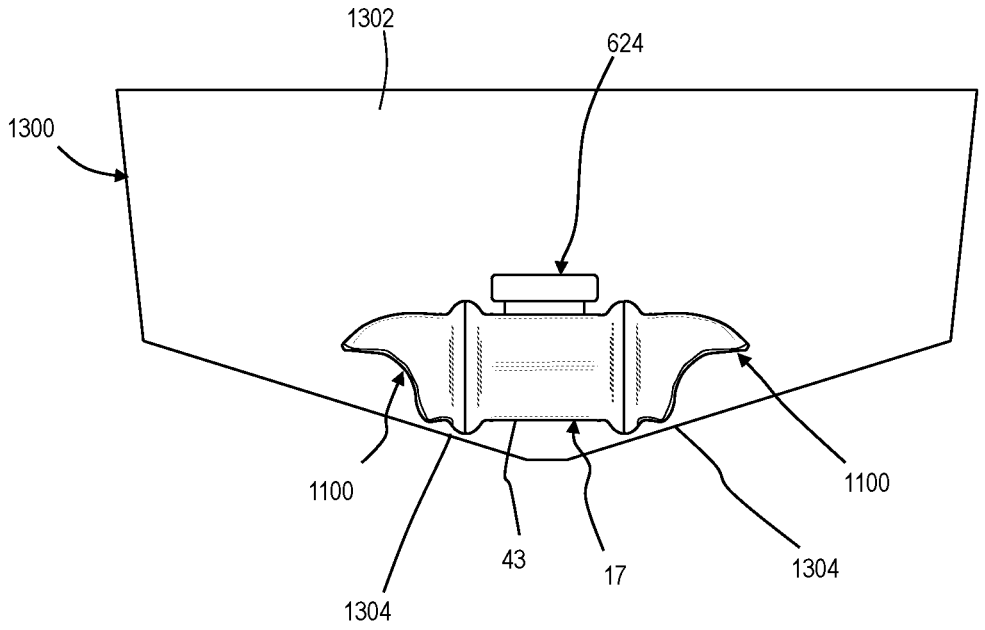
FIG. 13 shows a thruster assembly with thrust directors where the thruster assembly is mounted on the transom of a boat, in accordance with some embodiments.

FIG. 13 shows a thruster assembly with thrust directors 1100 where the thruster assembly is mounted on the transom 1302 of a boat 1300, in accordance with some embodiments. Here the thrust directors 1100 are fully mounted on and attached to the thruster 17, and specifically the guide tube 43 of the thruster 17. Further, the bracket 600, which holds the thruster 17, is further mounted on the transom 1302 of the boat 1300, similarly to that shown in FIG. 3. It can be seen here that the thruster assembly, including the thruster 17 and thrust directors 1100, are mounted such that the thrust assembly does not extend lower than the bottom of the hull line 1304 of the boat 1300. This prevents the thruster assembly from being in the water when the boat is on plane. However, when the boat is moving very slowly, the thruster assembly will be under water. From this view it can be appreciated that the thruster can direct water in either direction, left or right in the drawing, to move the back end of the boat accordingly.

Figure 14:
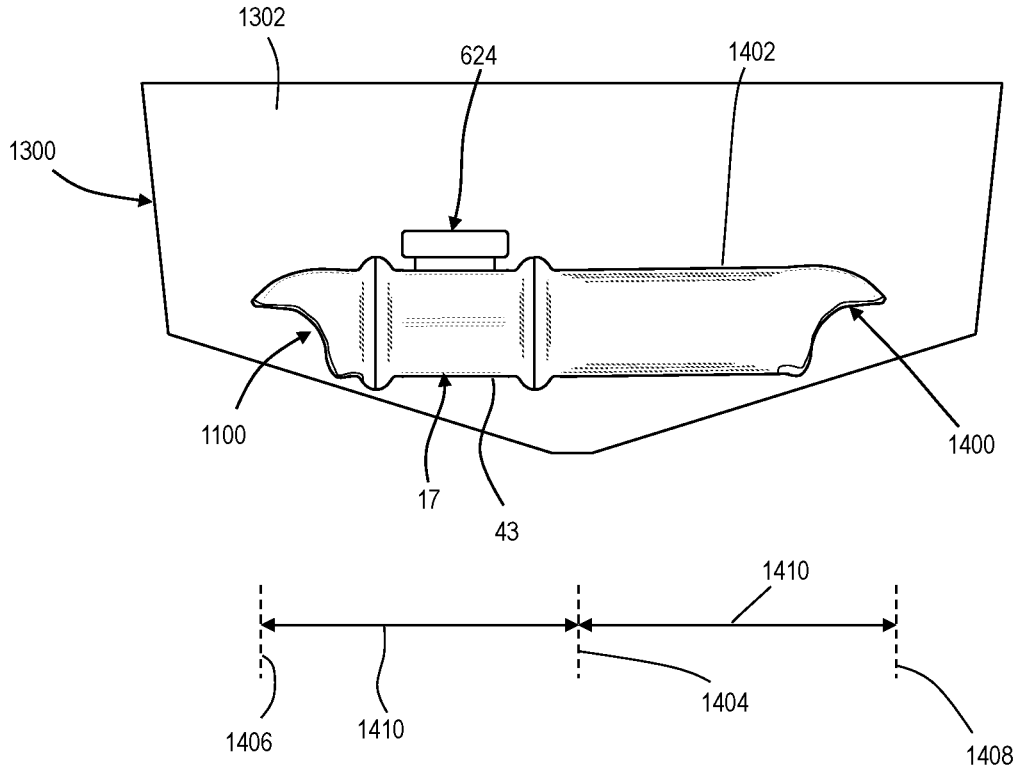
FIG. 14 shows the use of an extended thruster guide on one side of a thruster guide tube to allow off-center mounting of a thruster, in accordance with some embodiments.

FIG. 14 shows the use of an extended thrust director 1400 on one side of a thruster guide tube 43 to allow off-center mounting of a thruster 17, in accordance with some embodiments. It is contemplated that in some applications the bracket cannot be mounted in the center of the transom 1302 due to there being other equipment mounted there, such as, for example, a wake shaper. Accordingly, the thruster 17 has be mounted off-center on the transom 1302. However, if the same size thrust directors are used on each side of the thruster 17, as in FIG. 13, then the boat will respond differently to the thrust generated by the thruster 17 depending on the direction of thrust. In this example, a thrust director 1100 as in FIGS. 11A-13 is mounted on the left (port) side of the thruster, and an extended thrust director 1400 is mounted on the other side (starboard) of the thruster 17. The extended thrust director 1400 is identical to thrust director 1100, with the exception of the tube body 1402 being substantially longer than that of thrust director 1100. The center line of the boat 1300 is represented by line 1404; the thruster 17 is positioned off-center such that the ends of the thrust directors 1100, 1300 extend to lines 1406 and 1408, respectively, which are each a distance 1410 from the center line 1404. As a result, the thrust generated by the thruster 17 is balanced in both directions and has substantially the same effect on the boat in the opposite directions.

The invention can be modified in ways which will become apparent to those skilled in the art. The number and nature of the connectors can be varied. The length of the horizontal and vertical members can be changed. These and other modifications, which will be apparent to persons skilled in the art, should be considered within the spirit and scope of the following claims.

The claims appended hereto are meant to cover all modifications and changes within the scope and spirit of the present invention.

What is claimed is:

1. A thruster bracket, comprising:

an upper mounting support portion having a support plate portion that extends downward from a bottom of the upper mounting support portion and which defines a transom-facing surface together with a rear side of the upper mounting support portion;

a horizontal neck portion that extends from the upper mounting support portion opposite the transom-facing surface; and an enclosure portion extending from the horizontal neck portion opposite the upper mounting support portion; and wherein a bottom of the enclosure portion and the horizontal neck portion define a horizontal plane, an angle between the horizontal plane at a bottom of the horizontal neck portion and the transom-facing surface is greater than ninety degrees.

2. The thruster bracket of claim 1, wherein the angle between the horizontal plane at the bottom of the horizontal neck portion and the transom-facing surface is between ninety three and one hundred and eight degrees.

3. The thruster bracket of claim 1, further comprising a threaded conduit extending from the upper mounting support portion from an opening in the transom-facing surface, the threaded conduit having an axis that is at ninety degrees to the transom-facing surface.

4. The thruster bracket of claim 3, further comprising a rubber pad having an opening that fits over the threaded conduit and wherein the rubber pad lays against the transom-facing surface.

5. The thruster bracket of claim 1, wherein the enclosure has a recessed rim at a tip of the enclosure portion and includes a cover that sits on the recessed rim.

6. The thruster bracket of claim 1, wherein the bottom of the enclosure portion includes openings for receiving threaded fasteners of a thruster to couple the thruster to the thruster bracket.

7. A bracket for mounting a thruster to a boat, the bracket comprising:

a horizontal neck portion that extends from an upper mounting support portion, a support plate portion extending downward from the upper mounting support portion and forming a transom-facing surface with a rear of the upper mounting support portion;

the horizontal neck portion and support plate portion positioned generally greater than a right angle to each other;

an enclosure portion extends from the horizontal neck portion opposite the upper mounting support portion, the enclosure portion having openings in a bottom of the enclosure portion to couple the bracket to a thruster; and the enclosure portion having a recessed cover.

8. The bracket of claim 7, wherein the horizontal neck portion has a width, and wherein the upper mounting support portion has a width has a length, and wherein the width of the horizontal neck portion is smaller than the width of the upper mounting support portion.

9. The bracket of claim 7, further comprising a threaded conduit extending from the rear of the upper mounting support portion that in cylindrical and open into the horizontal neck portion and to the enclosure portion.

10. The bracket of claim 9, further comprising a pad having an opening disposed on the transom-facing surface with the threaded conduit passing through the opening.

11. The bracket of claim 9, wherein the support plate portion has in inverted triangular shape, the bracket further comprises a plurality of bolts including one bolt that passes through the support plate portion and the pad at a lower tip of the support plate portion, and two bolts on either side of the horizontal neck portion that pass through the upper mounting support portion and the pad.

12. The bracket of claim 7, wherein the enclosure portion is wider that either the upper mounting support portion of the horizontal neck portion.

13. A transom-mounted thruster system, comprising:

a bracket having a horizontal neck portion that extends from an upper mounting support portion, a support plate portion extending downward from the upper mounting support portion and forming a transom-facing surface with a rear of the upper mounting support portion, the horizontal neck portion and support plate portion positioned generally greater than a right angle to each other, an enclosure portion that extends from the horizontal neck portion opposite the upper mounting support portion, the enclosure portion having openings in a bottom of the enclosure portion to couple the bracket to a thruster; and a thruster mounted to an underside of the enclosure portion of the bracket and having a motor portion that is disposed under the horizontal neck portion, and a horizontally oriented guide tube having opposing open ends in which a propeller is located, the horizontally oriented guide tube being oriented in a direction perpendicular to an elongated direction of the horizontal neck portion of the bracket.

14. The transom-mounted thruster system of claim 13, further including a first thrust director coupled to a first one of the opposing open ends of the guide tube, and a second thrust director coupled to a second one of the opposing open ends of the guide tube, wherein each of the first and second thrust directors include an overhang at a top that directs water in a sideward and downward direction.

* * * * *